US005855234A

United States Patent [19]

Everts et al.

[11] Patent Number: 5,855,234

[45] Date of Patent: Jan. 5, 1999

[54] ROUTER TABLE ASSEMBLY WITH MICROSET THROAT PLATE

[75] Inventors: Robert G. Everts, Chandler; Kenneth M. Brazell, Phoenix, both of Ariz.

[73] Assignee: Ryobi North America Inc., Anderson, S.C.

[21] Appl. No.: 893,604

[22] Filed: Jul. 14, 1997

[51] Int. Cl.[6] ..... B27C 5/00

[52] U.S. Cl. ..... 144/135.2; 144/137; 144/253.2; 409/204; 409/214; 409/229

[58] Field of Search ..... 144/130, 134.1, 144/135.2, 136.95, 154.5, 371, 372, 253.1, 253.2; 409/174, 182, 204, 214, 229

[56] References Cited

U.S. PATENT DOCUMENTS

| | | | |
|---|---|---|---|
| 2,392,035 | 1/1946 | Fett . | |
| 3,841,368 | 10/1974 | Ritter | 144/134.1 |
| 4,031,934 | 6/1977 | Stadler | 144/130 |
| 4,353,672 | 10/1982 | Smith | 144/154.5 |
| 4,679,606 | 7/1987 | Bassett | 144/135.2 |
| 4,741,370 | 5/1988 | Heaton . | |
| 5,042,542 | 8/1991 | Purviance | 144/135.2 |
| 5,063,983 | 11/1991 | Barry | 144/371 |
| 5,271,441 | 12/1993 | Gakhar et al. | 144/136.95 |
| 5,398,740 | 3/1995 | Miller | 144/135.2 |
| 5,699,844 | 12/1997 | Witt | 144/136.95 |
| 5,715,880 | 2/1998 | Tucker et al. | 144/135.2 |
| 5,725,038 | 3/1998 | Tucker et al. | 144/135.2 |

*Primary Examiner*—W. Donald Bray
*Attorney, Agent, or Firm*—Brooks & Kushman P.C.

[57] ABSTRACT

A router table assembly includes a removable throat plate having a frame with a generally-planar upper surface, and an opening formed in the frame's upper surface. A disc, supported within the opening for rotation about a first axis, includes a through-hole which is sized to permit extension therethrough of a routing bit along a second axis parallel to the first axis. A graduated scale on the frame adjacent to the disc cooperates with a reference mark on the disk to provide an indication of the displacement of the bit's second axis relative to a reference edge on the working surface. A clamp secures the disc against rotation after the disc has been rotated within the frame to position the bit's second axis a desired distance from the reference edge. A fence is secured in one of a plurality of parallel-spaced positions relative to the reference edge.

20 Claims, 1 Drawing Sheet

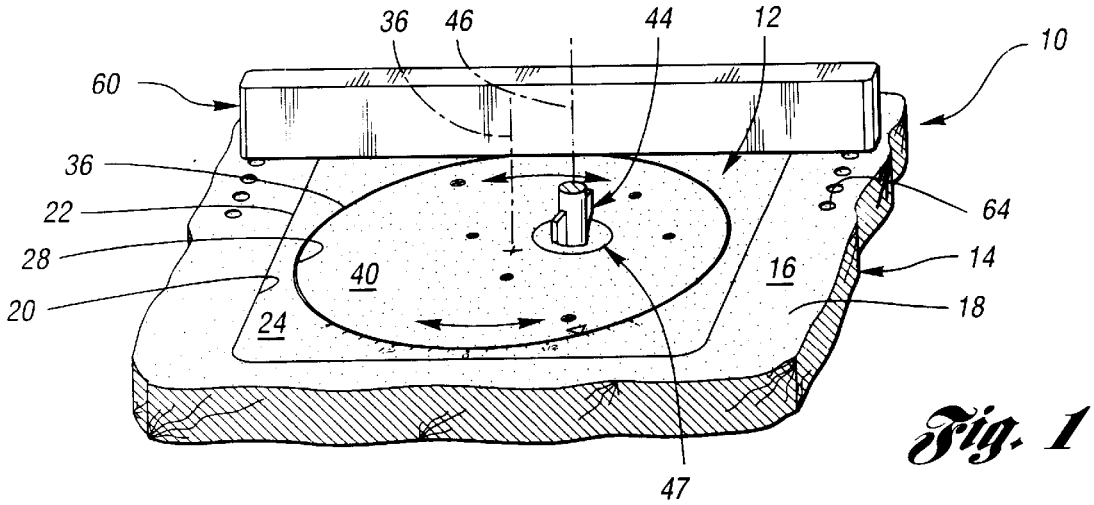
Fig. 1
Fig. 2
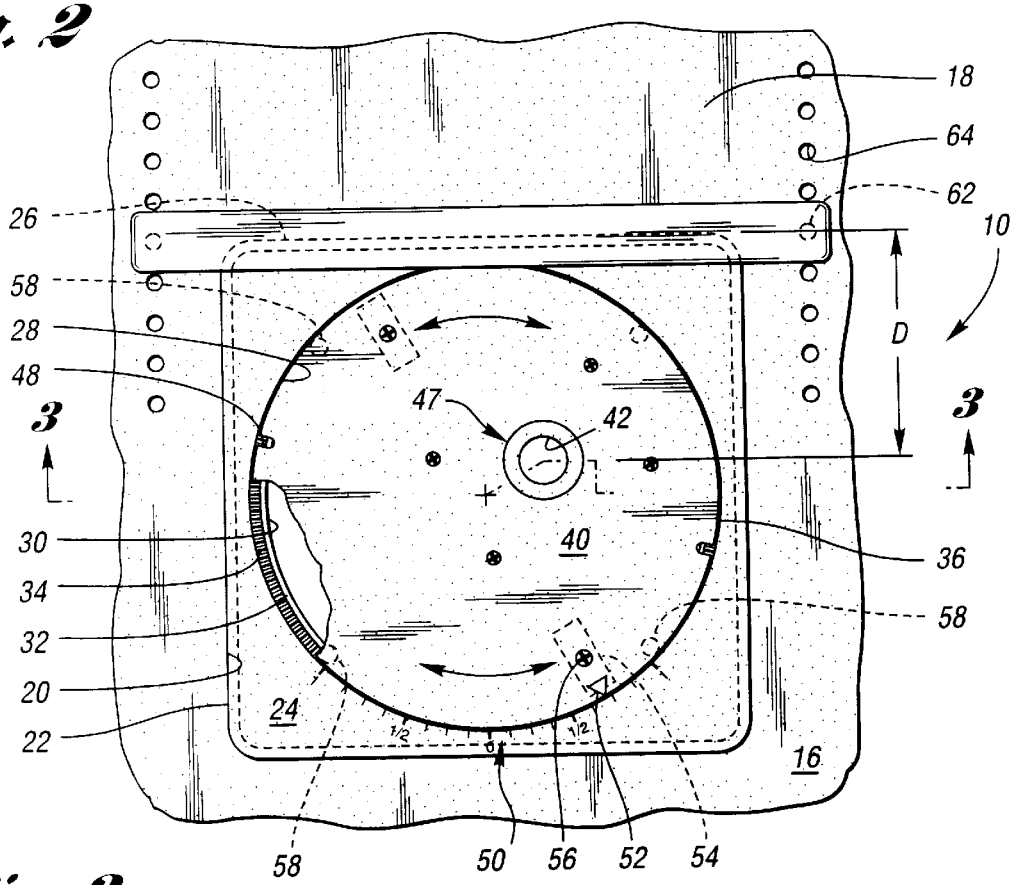
Fig. 3
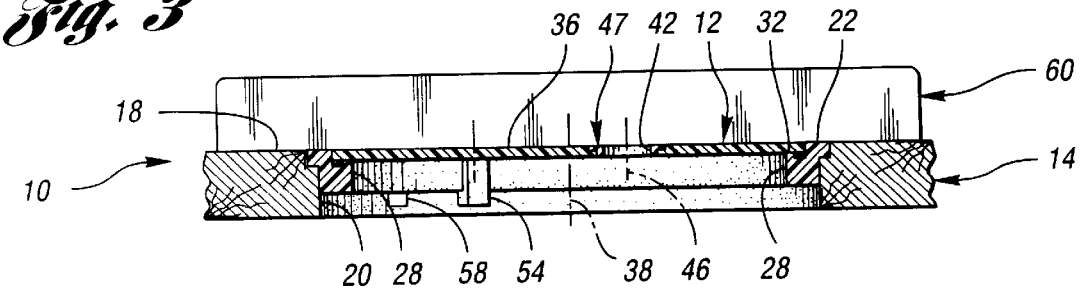

ROUTER TABLE ASSEMBLY WITH MICROSET THROAT PLATE

TECHNICAL FIELD

The invention relates to router tables which include a removable or detachable throat plate with which to hang a router beneath the table's working surface.

BACKGROUND ART

In a conventional router table assembly, a router is hung beneath the assembly's working surface such that a routing tool or "bit" driven by the router extends upwardly through a hole in the assembly's working surface to engage a workpiece manipulated by an operator on the working surface. The router is either secured directly to the underside of the table or, more preferably, the router is secured to a throat plate, which is typically a thin panel which is received and supported in a complementary hole or recess formed in the assembly's working surface, with the upper surface of the panel being flush with the working surface.

Prior art throat plates often comprise a simple, rectangular plate, commonly formed of an acrylic, having a central aperture through which the routing bit may extend. Unfortunately, router table assemblies employing such non-adjustable throat plates must necessarily rely upon accurate and reliable positioning of a fence in order to achieve consistent "final cut" dimensions. Complex and costly fence-locating mechanisms are thus required in assemblies employing such nonadjustable plates particularly where "fine tuning" of fence position is periodically required.

The prior art alternatively teaches throat plates which employ a lead screw and sliding plate system to achieve limited adjustability relative to a fence. Such known adjustable throat plates, however, are complex and costly to manufacture. Moreover, such known adjustable throat plates are often difficult to adjust quickly and reliably. Accordingly, router table assemblies employing such known adjustable throat plates likewise employ the complex and costly fence-positioning mechanisms used with nonadjustable throat plates.

DISCLOSURE OF INVENTION

It is an object of the invention to provide a router table throat plate featuring quick, accurate, reliable and repeatable microadjustment of the distance between the axis about which a routing tool is driven and a reference edge on the router table's working surface.

It is also an object of the invention to provide a micro-adjustable router table throat plate which employs fewer parts and is less costly to manufacture than known adjustable router table throat plates.

Another object of the invention is to provide a router table assembly incorporating an improved microadjustable throat plate.

In accordance with the invention, a throat plate for supporting a router beneath a working surface of a router table includes a frame having an upper surface with which to define a first portion of the working surface, and an opening in the frame's upper surface. The throat plate further includes a disc supported within the opening of the frame for rotation about a first axis generally orthogonal to the frame's upper surface, preferably, through an arc of about 90 degrees. By way of example only, in a preferred embodiment, the disc is rotatably supported within the opening by a continuous shoulder formed internally of the opening.

In a preferred embodiment, the internal shoulder within the frame's opening also includes a plurality of grooves extending radially outwardly relative to the disc's rotational axis, while the disc includes one or more slots, each of which define at least one camming surface. The camming surfaces on the disc cooperate with the plurality of grooves in the internal shoulder to facilitate rotation of the disc relative to the frame upon insertion of a tool, such as a flat-blade screwdriver, through a given slot into one of the grooves and against the slot's camming surface.

In accordance with the invention, the disc itself includes an upper surface with which to define a second portion of the working surface, an under surface to which a router may be removably secured, and a through-hole intersecting the disc's upper surface. The disc's through-hole is sized to permit extension therethrough of a routing tool or "bit" along a second axis generally parallel to the first axis. In a preferred embodiment, an inner diameter of an annular insert, itself supported by the disc in concentricity with the second axis, advantageously defines the disc's through-hole, thereby allowing for the quick and convenient resizing of the through-hole when changing routing bits. By rotating the disc within the frame, relatively small adjustments to the distance between the axis of the routing bit and a reference edge on the router table's working surface are quickly, reliably and repeatably achieved.

The throat plate also includes a clamp for securing the disc against rotation relative to the frame, for example, after the disc has been rotated within the frame to provide a desired distance between the bit's second axis and the reference edge. In a preferred embodiment, the clamp is integrally formed with the disc. In a most preferred embodiment, both the frame and the disc are formed of an injection molded material, such as reinforced nylon, with the clamp conveniently and economically integrally molded with the disc.

The throat plate preferably further includes a reference mark on one of the disc and the frame, and a graduated scale on the other of the disc and the frame. The reference mark and graduated scale cooperate to provide an indication of the displacement of the bit's axis in a direction normal to the reference edge upon relative rotation of the disc within the frame.

Further in accordance with the invention, a router table assembly includes a router table having an upper surface defining a first portion of a generally-planar working surface, wherein the table's upper surface includes a recess. The router table assembly further includes a throat plate received and nonrotatably supported in the recess of the table's upper surface. The throat plate includes a frame having an upper surface defining a second portion of the assembly's working surface, and an opening formed in the frame's upper surface.

A disc is supported within the opening of the frame for rotation about a first axis generally orthogonal to the working surface, preferably through an arc of about 90 degrees relative to the frame. The disc has an upper surface defining a third portion of the assembly's working surface, and an under surface. The disc also has a through-hole intersecting the disc's upper surface which is preferably defined by the inner diameter of an annular insert supported by the disc. The disc's through-hole is sized to permit extension therethrough of a routing tool along a second axis generally parallel to the first axis. By rotating the disc within the frame, relatively small adjustments to the distance between the bit's second axis and a reference edge on the assembly's working surface are quickly, reliably and repeatably achieved.

As noted above in connection with the throat plate of the invention, the router table assembly further preferably includes a reference mark on one of the disc and the frame, and a graduated scale on the other of the disc and the frame. The reference mark and graduated scale cooperate to provide an indication of the displacement of the bit's second axis in a direction normal to the reference edge upon relative rotation of the disc within the frame. One or more clamps, each preferably integrally formed with the disc, are operative to secure the disc against rotation after the disc has been rotated to achieve a desired distance between the bit's second axis position relative to the reference edge.

In a preferred embodiment, where the disc is rotatably supported within the opening by a continuous shoulder formed internally of the opening, the shoulder includes a plurality of grooves extending radially outwardly relative to the disc's rotational axis. The disc preferably includes one or more slots, each of which define at least one camming surface. The camming surfaces on the disc cooperate with the plurality of grooves in the internal shoulder to facilitate rotation of the disc relative to the frame upon insertion of a tool, such as a flat-blade screwdriver, through a given slot into one of the grooves and against the slot's camming surface.

The router table assembly preferably further includes a fence secured to the table's upper surface in a fixed angular relationship with the reference edge of the assembly's working surface. Most preferably, the fence is secured to the table in parallel relation to the reference edge, in one of a plurality of parallel-spaced positions relative to the reference edge. In this manner, relatively large adjustments to the distance between the fence and the reference edge and, correlatively, between the fence and the axis of the bit, are quickly, reliably and repeatedly achieved.

The above and other objects, features, and advantages of the invention will be readily appreciated by one of ordinary skill in the art from the following detailed description when taken in connection with the accompanying drawings.

BRIEF DESCRIPTION OF DRAWINGS

FIG. 1 is a partial view in perspective of an exemplary router table assembly in accordance with the invention, further showing a routing bit projecting upwardly through the disc's through-hole from beneath the assembly's working surface;

FIG. 2 is a plan view of the router table assembly illustrated in FIG. 1, with the bit removed for clarity; and FIG. 3 is a sectional view of the router table assembly taken along line 3—3 of FIG. 2.

BEST MODE FOR CARRYING OUT THE INVENTION

Referring to FIG. 1, in accordance with the invention, an exemplary router table assembly 10 with a microset throat plate 12 includes a table 14 whose upper surface 16 defines a first portion of a generally-planar working surface 18. The table's upper surface 16 includes a generally-rectangular recess 20 within which to receive and nonrotatably support the throat plate 12.

Referring to FIGS. 1–3, the throat plate 12 itself includes a frame 22 having an upper surface 24 flush with the table's upper surface 16 and, hence, serving to define a second portion of the assembly's working surface 18. As seen in FIG. 2, one of the frame's edges 26 serves to define a reference edge on the working surface when the throat plate 12 is received in the table's complementary recess 20. While the frame 22 may be formed of any suitable material in any suitable manner, in a preferred embodiment, the frame 22 is formed of injection-molded glass-filled nylon. Stiffening ribs and other features common to injection-molded articles (not shown) may be included as necessary.

A generally cylindrical opening 28 is formed within the frame's upper surface 24. The opening 28 includes a circumferentially-continuous, radially-inwardly-projecting lip or shoulder 30. The radially-innermost portion of the shoulder 30 defines an annular surface 32 generally parallel to the frame's upper surface 24. The radially-outermost portion of the shoulder 30 includes a plurality of radial grooves 34, the purpose of which will be further described below.

The throat plate 12 also includes a disc 36 supported within the opening 28 of the frame 22 on the shoulder's annular surface 32 for rotation about a first axis 38 generally orthogonal to the assembly's working surface 18. As supported by the shoulder's annular surface 32, the disc's upper surface 40 is flush with the table's upper surface 16 and, hence, serves to define a third portion of the assembly's working surface 18. While the disc 36 may be formed of any suitable material in any suitable manner, in a preferred embodiment, the disc 36 is formed of injection-molded glass-filled nylon. Stiffening ribs and other features common to injection-molded articles (not shown) may be included as necessary.

The disc 36 includes a through-hole 42 intersecting its upper surface 40. The disc's through-hole 42 is sized to permit extension therethrough of a routing bit 44 along a second axis 46 generally parallel to the first axis 38. By rotating the disc 36 within the frame 22, relatively small adjustments to the distance D between the bit's axis 46 and the reference edge 26 are quickly, accurately, reliably and repeatably achieved.

By way of example only, in the exemplary embodiment 10 illustrated in the Figures, the through-hole 42 is readily sized for a given routing bit 44 using a selected one of a plurality of a removable, annular inserts 47, with the selected insert 47 supported by the disc 36 in concentricity with the second axis 46. More specifically, each of the inserts 47 has a nominal outer diameter but a different inner diameter with which to define the through-hole 42. The disc's through-hole 42 is thus conveniently sized to accommodate a given routing bit 44 by selecting the appropriate insert 47, with the further advantage of reducing any gap formed between the routing bit 44 and table's working surface 18.

The disc 36 preferably includes one or more peripheral slots 48. The slots 48 define camming surfaces on the disc 36 which cooperate with the grooves 34 in the frame opening's internal shoulder 30 to facilitate rotation of the disc 36 relative to the frame 22. By inserting a tool, such as a flat-blade screwdriver (not shown), through a given slot 48 into one of the grooves 34 and pivoting the screwdriver against the slot's camming surface, the disc 36 can be rotated in a very accurate and precise manner.

As best seen in FIG. 2, the router table assembly 10 includes a graduated scale 50 on the frame 22 adjacent to the disc 36, as well as a reference mark 52 on the periphery of the disc 36. The graduated scale 50 and reference mark 52 cooperate to provide an indication of the displacement D of the bit's axis 48 in a direction normal to the reference edge 26 upon relative rotation of the disc 36 within the frame 22.

As seen in FIGS. 2 and 3, the router table assembly 10 also includes clamps 54 which are operative to secure the disc 36 against rotation after the disc 36 has been rotated to achieve a desired distance D between the bit's axis 48 and the reference edge 26. While the clamps 54 may be of any suitable configuration and may be deployed in any suitable number, in the exemplary embodiment, where the disc 36 is preferably formed of an injection-molded material, a pair of diametrical clamps 54 are integrally formed on the disc's underside.

By way of example only, in the exemplary embodiment illustrated in the Drawings, each clamp 54 conveniently includes a clamp body whose radially-innermost portion is pivotally connected to the underside of the disc 36. A nut (not shown) mechanically captured within the clamp body cooperates with a slotted bolt 56 extending downwardly through the disc 36 to draw the clamp body up into engagement with the underside of the frame 22. It will be appreciated that the nut may either be captured within the clamp body during injection molding or may be pressed into a nut pocket previously molded in the clamp body.

In the exemplary embodiment illustrated in the Drawings, a pair of stops 58 are provided on the underside of the frame 22 adjacent to the opening 28. The stops 58 cooperate with the clamps 54 to limit the disc 36 to perhaps about 90 degrees of rotation relative to the frame 22.

The router table assembly 10 preferably further includes a fence 60 secured to the table's upper surface 16 in a fixed angular relationship with the reference edge 26. Most preferably, the fence 60 is secured to the table's upper surface 16 in parallel relation to the reference edge 26, in one of a plurality of parallel-spaced positions. By way of example only, in the exemplary embodiment illustrated in the Drawings, the fence 60 includes a pair of pins 62 which are received in discrete pairs of sockets 64 formed in the table's upper surface 16. In this manner, relatively large adjustments to the distance between the fence 60 and the reference edge 26 and, correlatively, between the fence 60 and the axis 48 of the bit 44, are quickly, accurately, reliably and repeatedly achieved.

While the best mode for carrying out the invention has been described in detail, those familiar to the art to which this invention relates will recognize various alternative designs and embodiments for practicing the invention as defined by the following claims. For example, while the frame's opening 28 and the disc's through-hole 42 in the disclosed and illustrated embodiment are each nominally of circular cross-section, the invention contemplates use of openings 28 and through-holes 42 of other nominal configurations.

Similarly, while the illustrated embodiment employs grooves 34 formed in the radially-outward portion of the frame opening's (continuous) internal shoulder 30, the invention alternatively contemplates use of a radially-slotted (discontinuous) internal flange or a plurality of discrete inwardly-extending projections, or other suitable configurations which cooperate with the slots formed in the disc 36 to facilitate rotation of the disc 36 within the frame 22. Similarly, while the illustrated embodiment shows slots 48 formed in the periphery of the disc 36, the invention contemplates use of other suitable disc apertures not otherwise intersecting the disc's peripheral edge.

What is claimed is:

1. A throat plate for supporting a router beneath a working surface of a router table such that a tool driven by the router extends above the working surface, the throat plate comprising:

a frame having an upper surface with which to define a first portion of the working surface, and an opening formed in the upper surface of the frame;

a disc supported within the opening of the frame for rotation about a first axis generally orthogonal to the upper surface of the frame, the disc having an upper surface with which to define a second portion of the working surface, and a through-hole intersecting the upper surface of the disc, the through-hole being sized to permit extension therethrough of the routing tool along a second axis generally parallel to the first axis; and a clamp for securing the disc against rotation relative to the frame.

2. The throat plate of claim 1, including a reference mark on one of the disc and the frame, and a graduated scale on the other of the disc and the frame, wherein the reference mark and graduated scale cooperate to provide an indication of the displacement of the second axis in a direction normal to reference edge on the working surface upon rotation of the disc relative to the frame.

3. The throat plate of claim 1, wherein the opening includes an internal shoulder defining an annular bearing surface for rotatably supporting the disc.

4. The throat plate of claim 3, wherein the internal shoulder includes a plurality of grooves extending radially outwardly relative to the first axis.

5. The throat plate of claim 4, wherein the disc includes a slot defining a vertical camming surface, wherein the camming surface cooperates with the plurality of grooves in the internal shoulder to facilitate rotation of the disc relative to the frame upon insertion of a tool through the slot into one of the grooves and against the camming surface.

6. The throat plate of claim 1, wherein at least one of the frame and the disc is formed of an injection molded material.

7. The throat plate of claim 1, wherein the clamp is integrally formed with the disc.

8. The throat plate of claim 1, wherein the disc is rotatable within the opening through an arc of about 90 degrees relative to the frame.

9. The throat plate of claim 1, further including an annular insert supported by the disc in concentricity with the second axis, and wherein the through-hole is defined by an inner diameter of the insert.

10. A router table assembly comprising:

a router table having an upper surface defining a first portion of a generally-planar working surface with a reference edge, wherein the upper surface of the table includes a recess, a throat plate nonrotatably supported in the recess of the table, the throat plate including a frame having an upper surface defining a second portion of the working surface, and an opening formed in the upper surface of the frame; a disc supported within the opening of the frame for rotation about a first axis, the disc having an upper surface defining a third portion of the working surface, an under surface, and a through-hole intersecting the upper surface of the disc, the through-hole being sized to permit extension therethrough of the routing tool along a second axis generally parallel to the first axis; and a clamp for securing the disc against rotation relative to the frame, and a fence secured to the table in a fixed angular relationship with the reference edge.

11. The router table assembly of claim 10, including a reference mark on one of the disc and the frame, and a graduated scale on the other of the disc and the frame, wherein the reference mark and graduated scale cooperate to provide an indication of the displacement of the second axis in a direction normal to the reference edge upon rotation of the disc relative to the frame.

12. The router table assembly of claim 10, wherein the opening includes an internal shoulder defining an annular bearing surface for rotatably supporting the disc.

13. The router table assembly of claim 12, wherein the internal shoulder includes a plurality of grooves extending radially outwardly relative to the first axis.

14. The router table assembly of claim 13, wherein the disc includes a slot defining a vertical camming surface, wherein the camming surface cooperates with the plurality of grooves in the internal shoulder to facilitate rotation of the disc relative to the frame upon insertion of a tool through the slot into one of the grooves and against the camming surface.

15. The router table assembly of claim 10, wherein at least one of the frame and the disc is formed of an injection molded material.

16. The router table assembly of claim 10, wherein the clamp is integrally formed with the disc.

17. The router table assembly of claim 10, wherein the disc is rotatable within the opening of the frame through an arc of about 90 degrees relative to the frame.

18. The router table assembly of claim 10, further including an annular insert supported by the disc in concentricity with the second axis, and wherein the through-hole is defined by an inner diameter of the insert.

19. The router table assembly of claim 10, wherein the fence is secured to the table in parallel relation to the reference edge.

20. The router table assembly of claim 19, wherein the fence is secured to the table in one of a plurality of parallel-spaced positions relative to the reference edge.

* * * * *